US010559907B1

(12) United States Patent
Baldwin et al.

(10) Patent No.: US 10,559,907 B1
(45) Date of Patent: Feb. 11, 2020

(54) ELECTRICAL PLUG CONNECTOR

(71) Applicants: Jeffrey Baldwin, Anthem, AZ (US); John Klein, Gilbert, AZ (US); Ryan Liebengood, Gilbert, AZ (US)

(72) Inventors: Jeffrey Baldwin, Anthem, AZ (US); John Klein, Gilbert, AZ (US); Ryan Liebengood, Gilbert, AZ (US)

( * ) Notice: Subject to any disclaimer, the term of this patent is extended or adjusted under 35 U.S.C. 154(b) by 0 days.

(21) Appl. No.: 15/893,665

(22) Filed: Feb. 11, 2018

Related U.S. Application Data

(63) Continuation of application No. 15/228,965, filed on Aug. 4, 2016, now Pat. No. 9,905,957, which is a continuation of application No. 14/694,445, filed on Apr. 23, 2015, now Pat. No. 9,431,732.

(60) Provisional application No. 61/988,258, filed on May 4, 2014.

(51) Int. Cl.

| | |
|---|---|
| ***H01R 13/436*** | (2006.01) |
| ***H01R 13/50*** | (2006.01) |
| ***H01R 13/512*** | (2006.01) |
| ***H01R 4/48*** | (2006.01) |
| ***H01R 4/40*** | (2006.01) |
| ***H01R 13/426*** | (2006.01) |
| *H01R 4/42* | (2006.01) |
| *H01R 4/44* | (2006.01) |

(52) U.S. Cl.
CPC ..... *H01R 13/436* (2013.01); *H01R 4/40* (2013.01); *H01R 4/489* (2013.01); *H01R 13/426* (2013.01); *H01R 13/501* (2013.01); *H01R 13/512* (2013.01); *H01R 4/42* (2013.01); *H01R 4/44* (2013.01)

(58) Field of Classification Search
CPC .. H01R 13/512; H01R 13/04; H01R 13/5829; H01R 13/5833; H01R 11/26; H01R 24/30; H01R 2103/00
USPC ..... 439/675, 441, 457, 135, 138
See application file for complete search history.

(56) References Cited

U.S. PATENT DOCUMENTS

| | | | | | |
|---|---|---|---|---|---|
| 3,571,781 | A * | 3/1971 | Gartland, Jr. | H01R 13/595 | 439/465 |
| 3,784,961 | A * | 1/1974 | Gartland, Jr. | H01R 13/595 | 174/156 |
| 3,856,376 | A * | 12/1974 | Poliak | H01R 13/502 | 439/465 |
| 3,943,310 | A | 3/1976 | Gertz | | |
| 5,219,304 | A * | 6/1993 | Lin | H01R 13/502 | 439/461 |
| 5,242,315 | A * | 9/1993 | O'Dea | G02B 6/3817 | 385/59 |
| 5,586,916 | A * | 12/1996 | Shinji | H01R 13/501 | 439/448 |
| 5,588,870 | A * | 12/1996 | Boteler | H01R 13/502 | 439/467 |
| 5,645,447 | A * | 7/1997 | Sandor | H01R 13/436 | 439/467 |
| 6,126,478 | A * | 10/2000 | Presson | H01R 13/595 | 439/467 |

(Continued)

*Primary Examiner* — Harshad C Patel
(74) *Attorney, Agent, or Firm* — Booth Udall Fuller, PLC

(57) ABSTRACT

An electrical plug connector including a body having a cavity, an electrical connection portion on the body, a wire locking mechanism in the cavity, and a current transmitter electrically connecting the electrical connection portion and the wire locking mechanism. The body may include a cover pivotable from an open position to a closed position.

12 Claims, 11 Drawing Sheets

(56) References Cited

U.S. PATENT DOCUMENTS

| | | | | |
|---|---|---|---|---|
| 6,739,900 | B2 * | 5/2004 | Mortun | H01R 13/5837 439/460 |
| 6,814,595 | B2 * | 11/2004 | Miyamoto | H01R 13/62933 439/148 |
| 7,988,504 | B2 * | 8/2011 | Stromiedel | H01R 13/50 439/709 |
| 9,431,732 | B1 * | 8/2016 | Baldwin | H01R 13/5829 |

* cited by examiner

ELECTRICAL PLUG CONNECTOR

CROSS-REFERENCE TO RELATED APPLICATIONS

This application claims priority to U.S. patent application Ser. No. 15/228,965 filed on Aug. 4, 2016, now issued as U.S. Pat. No. 9,905,957 titled ELECTRICAL PLUG CONNECTOR, this application also claims priority to issued U.S. Pat. No. 9,431,732, filed as U.S. patent application Ser. No. 14/694,445 on Apr. 23, 2015 and titled ELECTRICAL PLUG CONNECTOR, and Provisional U.S. Patent Application No. 61/988,258, filed on May 4, 2014 and titled ELECTRICAL PLUG CONNECTOR to Baldwin et al., the disclosure of which is hereby incorporated herein by reference.

BACKGROUND

Extension cords and electrical cords in general are well known. During various tasks, multiple electrical devices may be needed or extension cords may be required to reach distant locations. During use, an electrical cord may be damaged by power equipment or just extended usage which can short the internal wiring. In this cases, the user may tear apart the electrical cord and wire a new end with soldering or crimp caps, followed by wrapping the connections in electrical tape.

SUMMARY

Aspects of this disclosure relate to an electrical plug connector. In one aspect, an electrical plug connector includes a body having a cavity, an electrical connection portion on the body, a wire locking mechanism in the cavity, and a current transmitter electrically connecting the electrical connection portion and the wire locking mechanism.

In an implementation, the electrical connection portion may further include a male electrical plug. The electrical connection portion may further include a female electrical receptacle. The body may include a cover. The cover may be pivotable from an open position to a closed position. At least one screw may be used to secure the cover to the body. The wire locking mechanism may be at least one screw. The at least one screw may be three screws. The wire locking mechanism may further include a wire retainer.

The wire retainer may be secured with at least one screw. At least one wire isolator may be positioned between a pair of electrical cable wires. Wire guides may be positioned in the cavity. A seal may be in the cavity. An interior portion of the cover may be recessed. The cover may further include a clasping mechanism. The clasping mechanism may be secured to the cover and the body. The wire locking mechanism may be formed on the cover. The wire locking mechanism may be spring biased in a locked position. The locking mechanism may be three separate locking mechanisms.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Embodiments of the present invention will hereinafter be described in conjunction with the appended drawings, where like designations denote like elements, and.

DETAILED DESCRIPTION

This disclosure, its aspects and implementations, are not limited to the specific components or assembly procedures disclosed herein. Many additional components and assembly procedures known in the art consistent with the intended operation and assembly procedures for an electrical plug connector will become apparent for use with implementations of an electrical plug connector from this disclosure. Accordingly, for example, although particular components are disclosed, such components and other implementing components may comprise any shape, size, style, type, model, version, measurement, concentration, material, quantity, and/or the like as is known in the art for such implementing components, consistent with the intended operation of an electrical plug connector.

Figure 1:
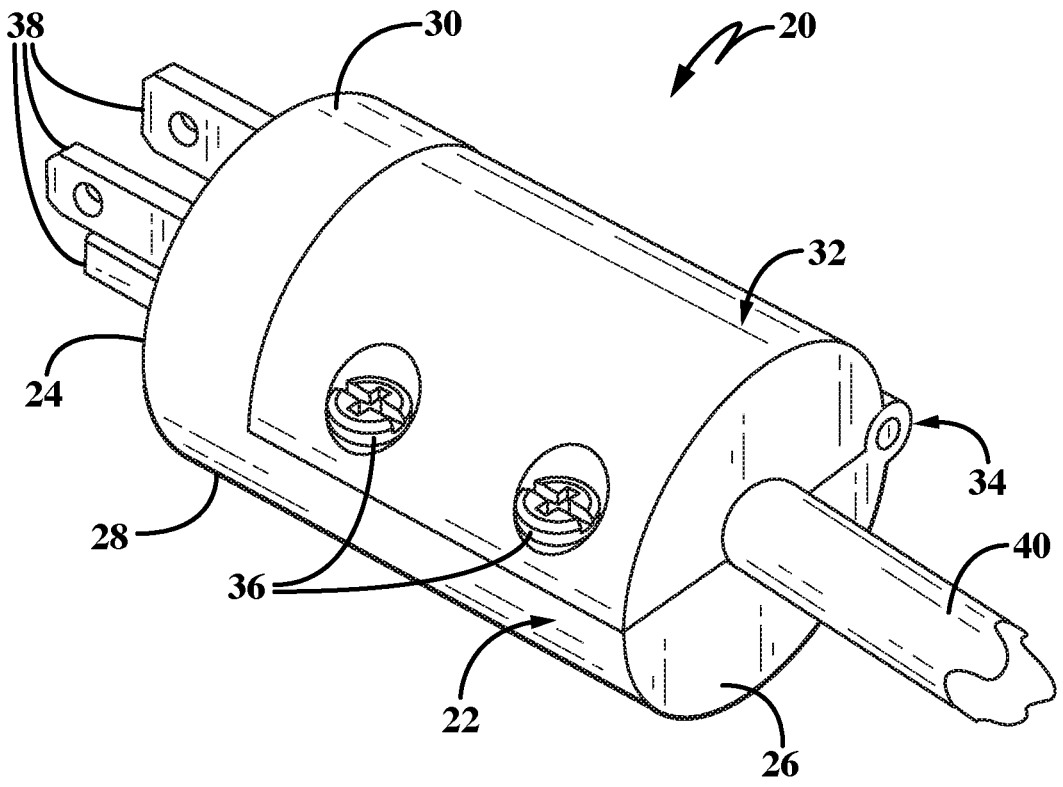
FIG. 1 is a perspective view of an electrical plug connector installed.
Figure 2:
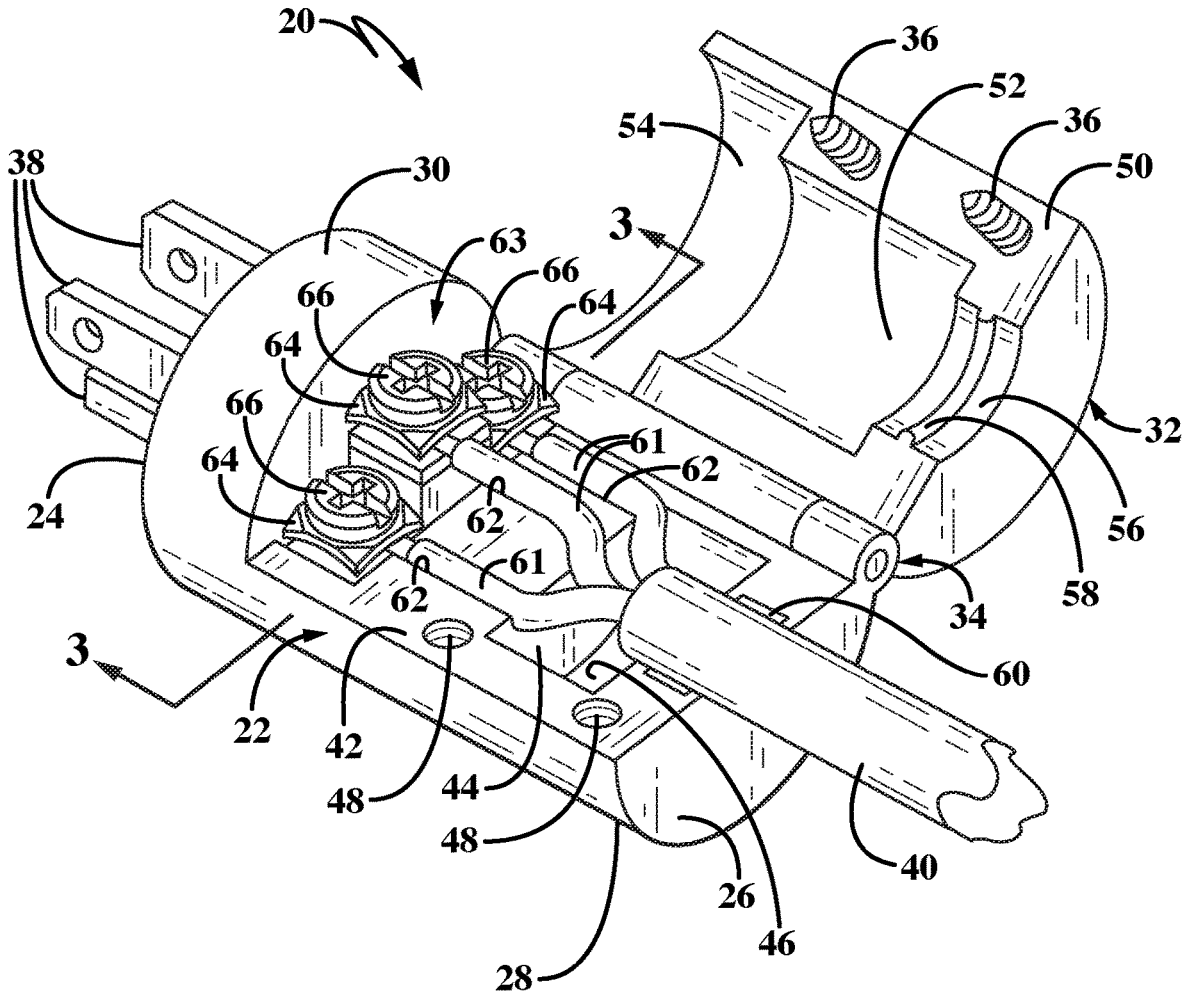
FIG. 2 is a perspective view of the electrical plug connector with a cover open.
Figure 3:
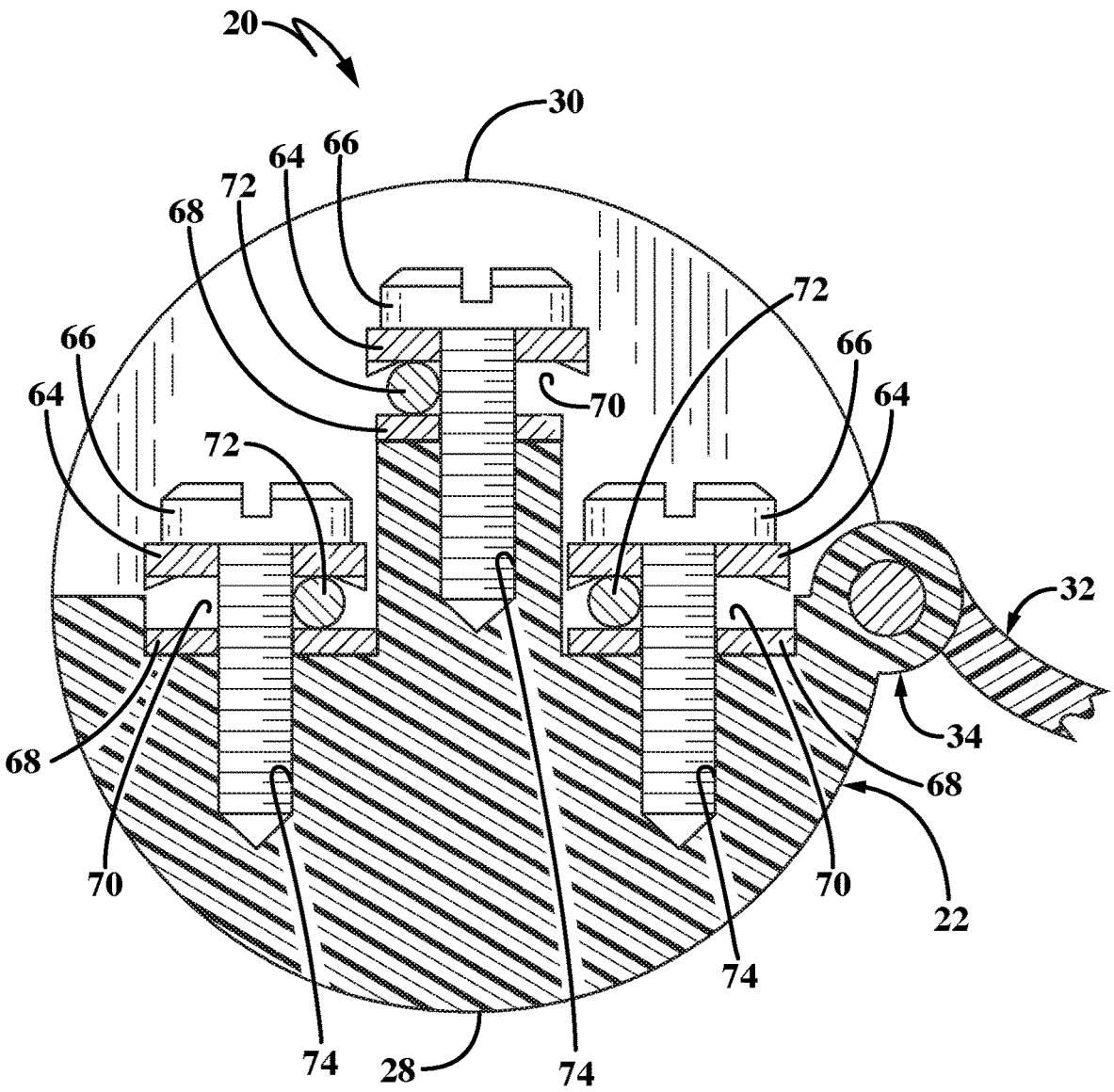
FIG. 3 is a sectional view taken generally about line 3-3 in FIG. 2.

FIGS. 1-3 illustrate various views of a first aspect electrical plug connector 20A having a body 22, a first end 24, a second end 26, a bottom surface 28, and a top surface 30. A cover 32 is connected at hinge 34 to body 22 for pivotably opening and closing cover 32 with respect to body 22. Cover 32 may be secured to body 22 with screws 36 to prevent inadvertent/accidental opening and to better secure the cavity therein. On first end 24 is an electrical connection portion 38 which may be a male electrical plug or a female electrical receptacle. An electrical cord 40 extends into a cavity of the electrical plug connector 20A as will be described in greater detail below. In all aspects and implementations, numbers 20A, 20B, and 20C are used to show and describe various aspects and implementations of an electrical plug connector. Each description or view may utilize electrical plug connector 20A, 20B, or 20C without departing from the spirit and scope of the present disclosure.

FIG. 2 illustrates a view with cover 32 in the open position, while FIG. 3 illustrates a sectional view thereof. Body 22 includes a top surface 42 with a cord management section 44 forming a perimeter or cavity 46. Threaded apertures 48 are arranged to receive screws 36. Cover 32 includes a bottom surface 50, a first recessed region 52, and a second recessed region 54. A cord entry portion 56 is located on second end 26 and includes a seal 58. A cord entry portion 60 may also be included in body 22 which may also include a seal. First recessed region 52 is oriented to permit wires 61 and cord 40 to be secured within cavity 46, while second recessed portion 54 is oriented to provide space for the wire locking mechanism 63. A current transmitter may be positioned between the wire locking mechanism and electrical connection portion to provide electrical continuity there between. In one implementation the current transmitter is merely wires connecting the wire contacts and the electrical connection portion. In another implementation, the current transmitter may be solid contacts, a semiconductor processor, or any suitable conducting device.

Wire sheaths 61 may be located within wire guides 62 and wires 72 may be located below washers 64 which are held in place with screws 66 when threaded into apertures 74. Washers 64 may include a curved perimeter to hold the wire in place and a hole in the middle of the washer for receiving the screw 66. A conductive member 68 is positioned below the washer 64 and forms a wire receiving region 70 defined in part by the washer 64 and the conductive member 68.

In operation, the electrical conductivity of the cable 40 is transferred through the wire locking mechanism to the current transmitter and ultimately to the electrical connection portion 38. The wires may be secured in place with screws and washers to prevent the wires from breaking free. In this manner, a damaged or destroyed electrical cord can have a replacement plug or receptacle which remains secured to the electrical cord.

Figure 4:
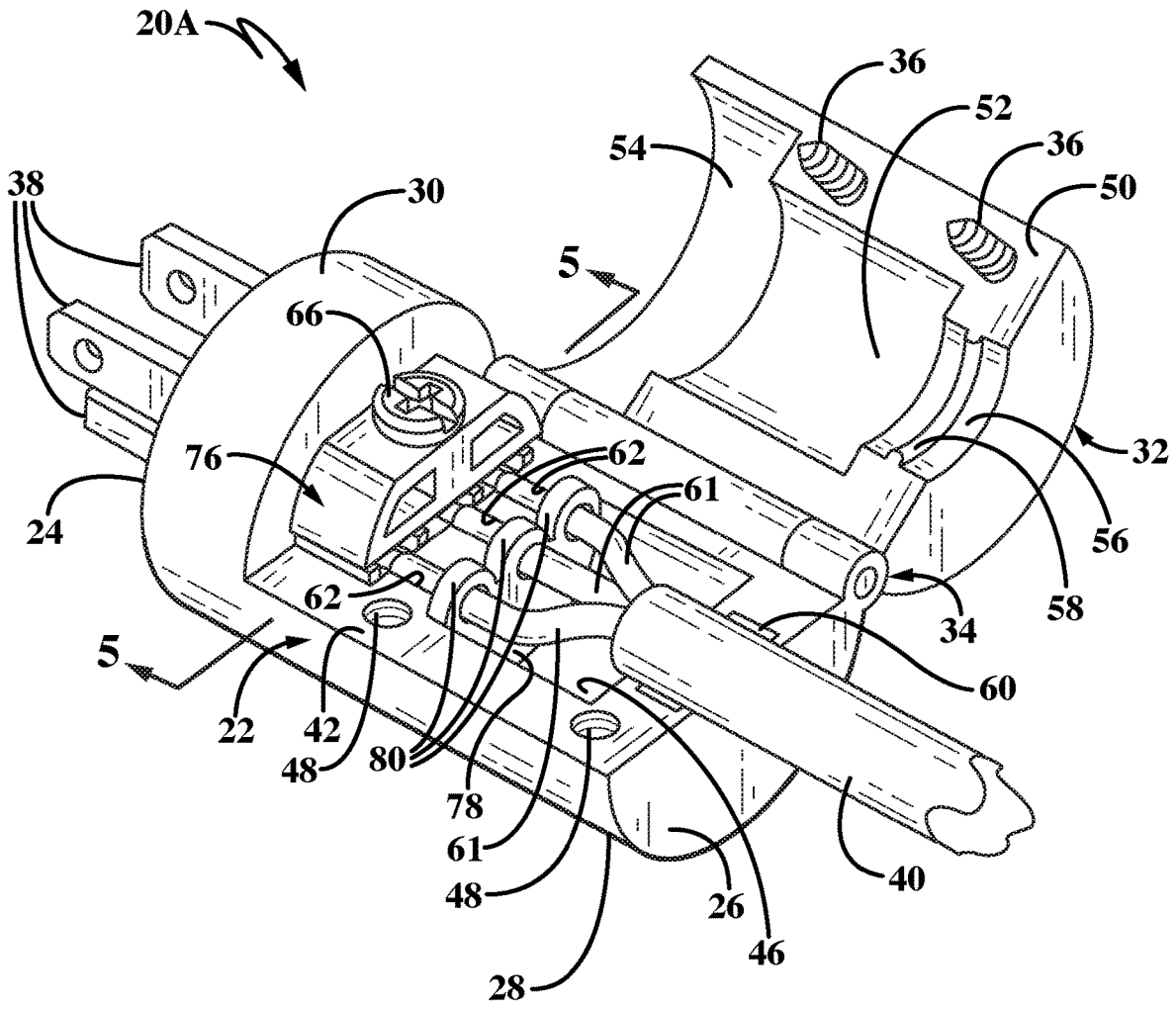
FIG. 4 is a perspective view of a second aspect electrical plug connector with the cover open.
Figure 5:
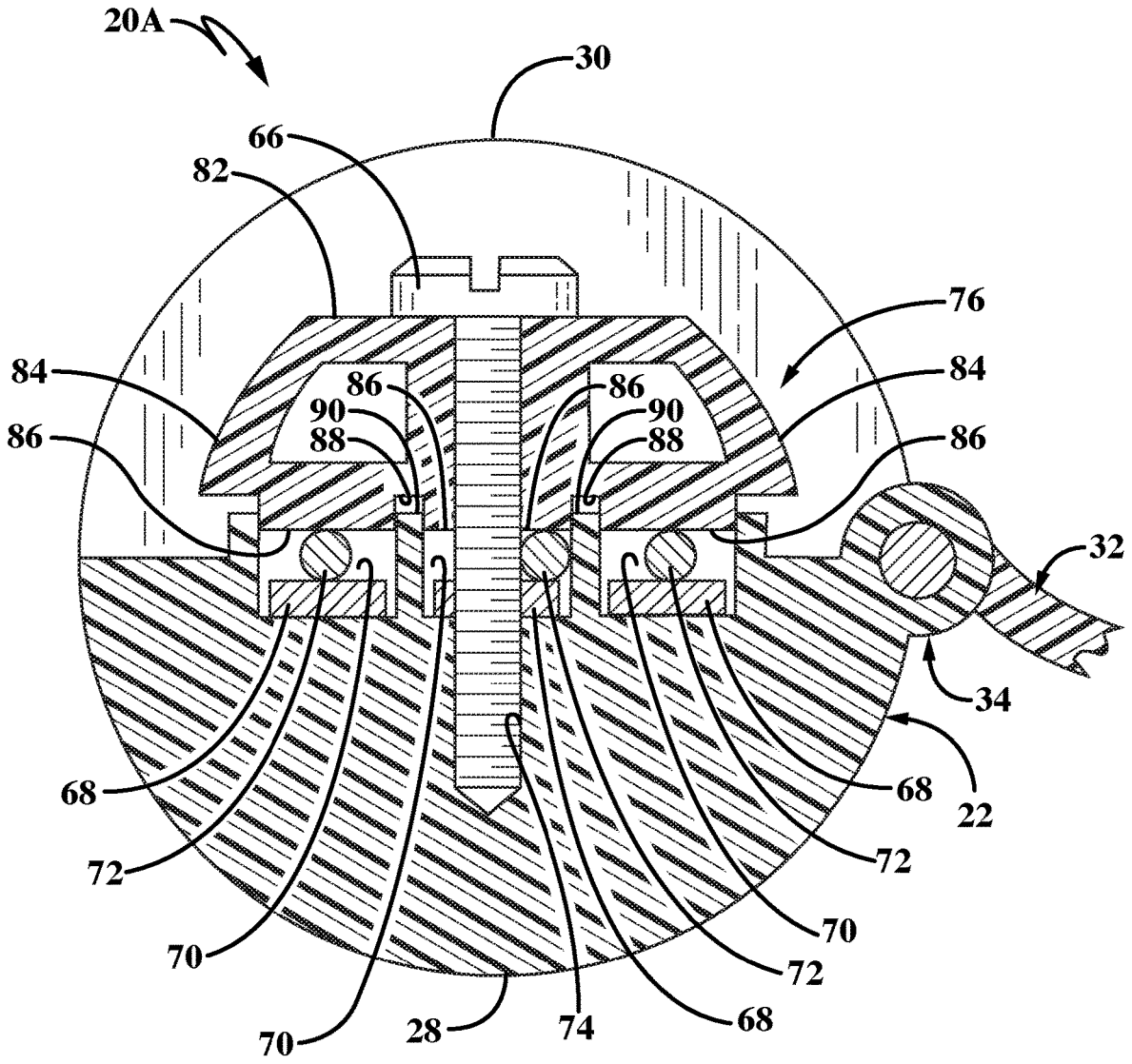
FIG. 5 is a sectional view taken generally about line 5-5 in FIG. 4.

FIGS. 4-5 illustrate a second aspect electrical plug connector having a different wire locking mechanism. Specifically, screw 66 is secured through a single wire locking mechanism 76 as the wires pass through guide 78 and individual wire guides 80. Wire locking mechanism 76 may include a top portion 82, curved portions 84 which align with the second recessed portion in cover 32. A bottom portion 86 may include apertures 88 for alignment with insulators or wire separators 90. The remaining components retain the same function and general features.

In operation, wires 72 are each positioned within wire receiving region 70 and positioned between bottom portion 86 and conductive member 68. The operator can then easily install the electrical plug connector by locating all three wires within the wire receiving regions and securing a single screw in the body of the electrical plug connector. In all aspects and implementations, wire receiving regions are used to secure the wires as well as provide electrical continuity to the replacement plug.

Figure 6:
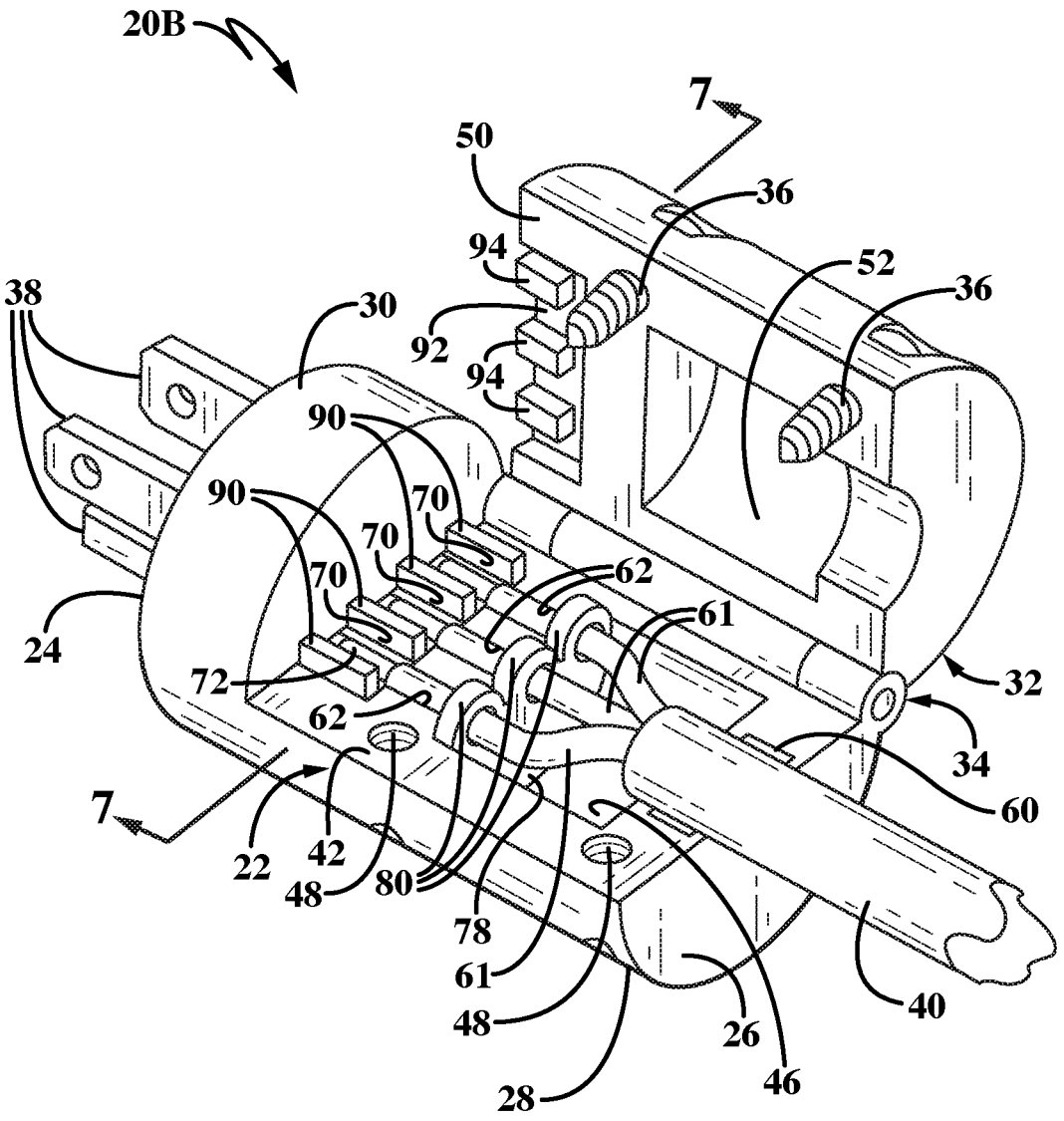
FIG. 6 is a perspective view of a third aspect electrical plug connector with the cover open.
Figure 7:
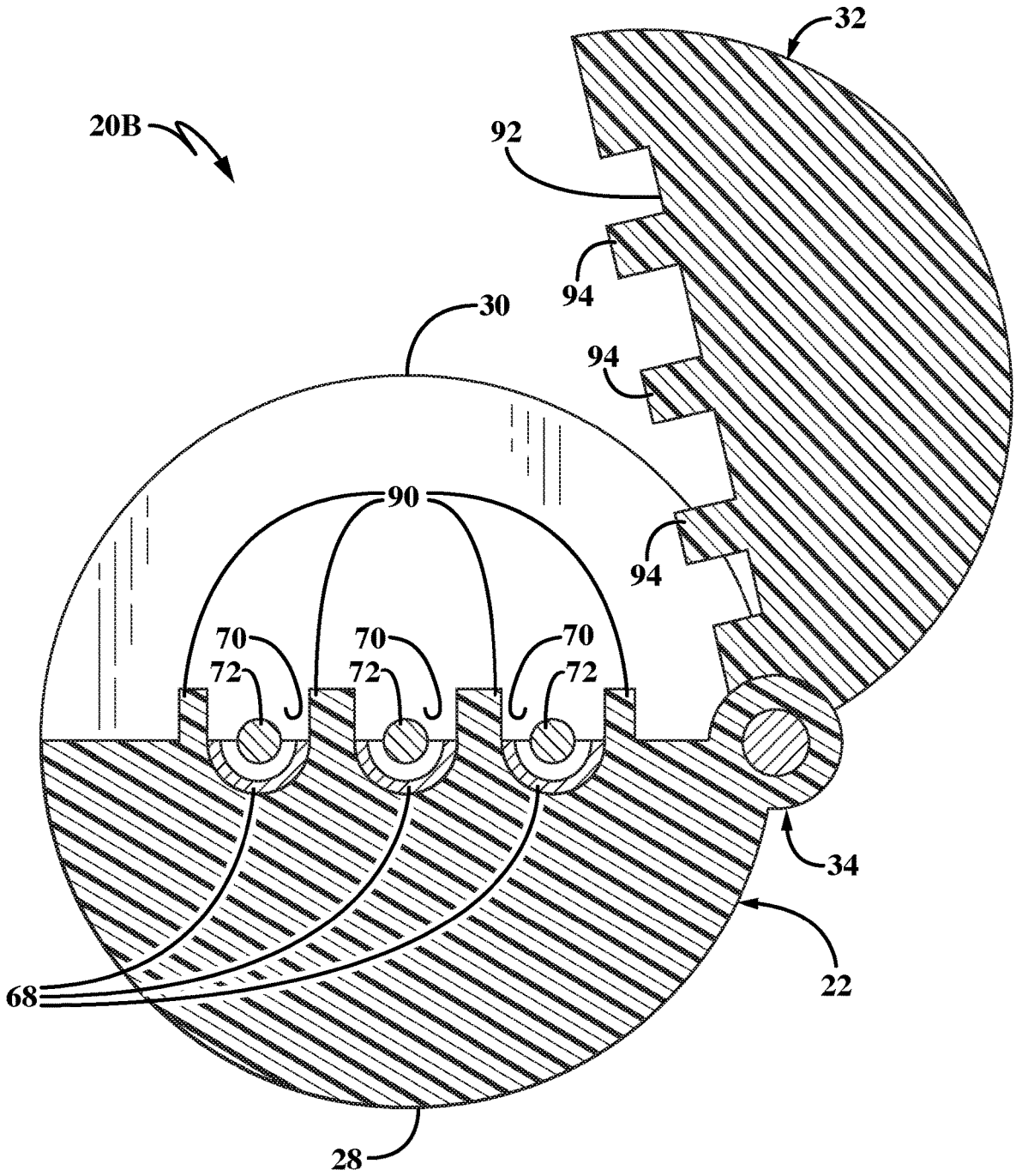
FIG. 7 is a sectional view taken generally about line 7-7 in FIG. 6.
Figure 8:
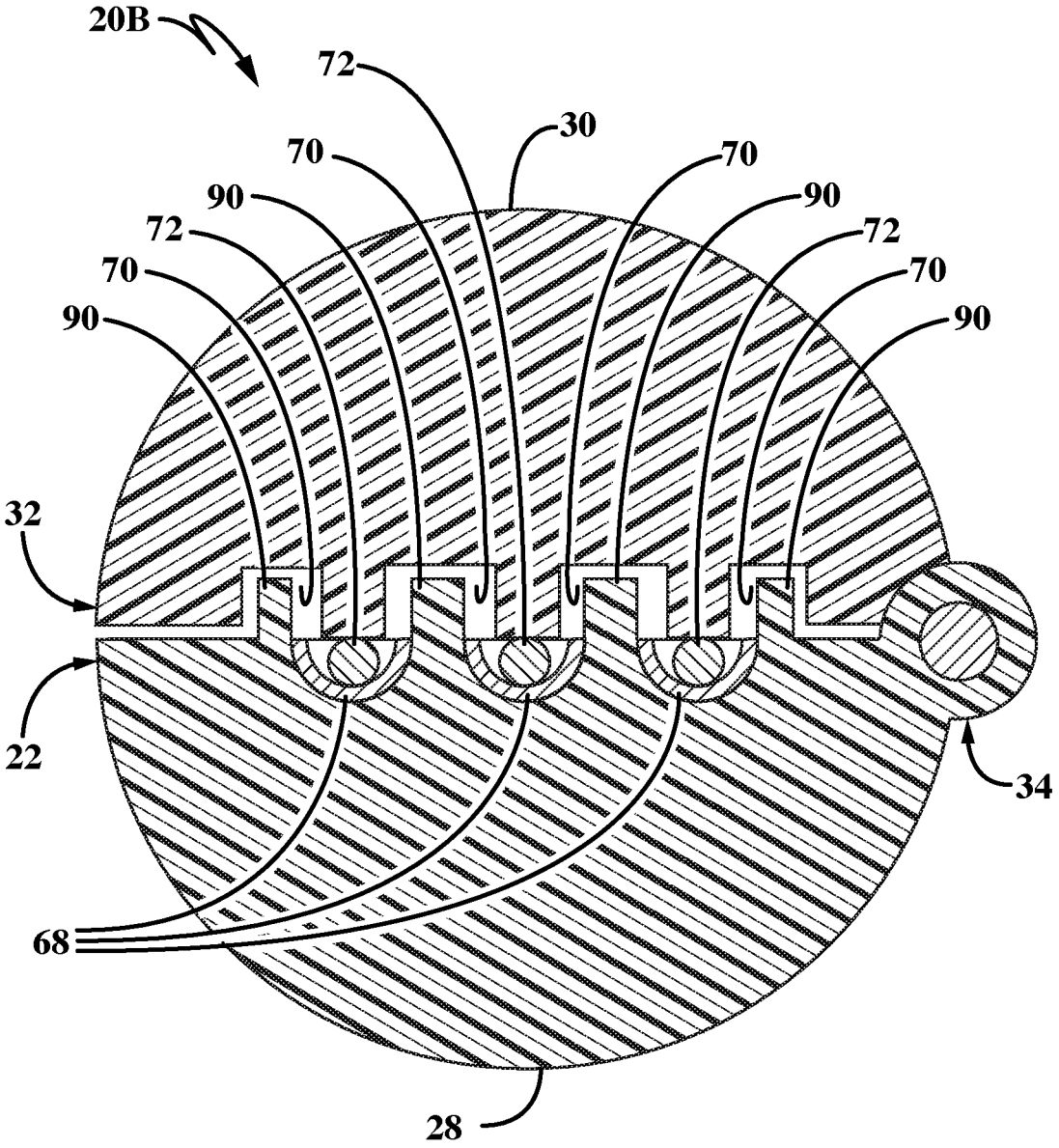
FIG. 8 is a sectional view taken generally about line 7-7 in FIG. 6 with the cover in the closed position.
Figure 9:
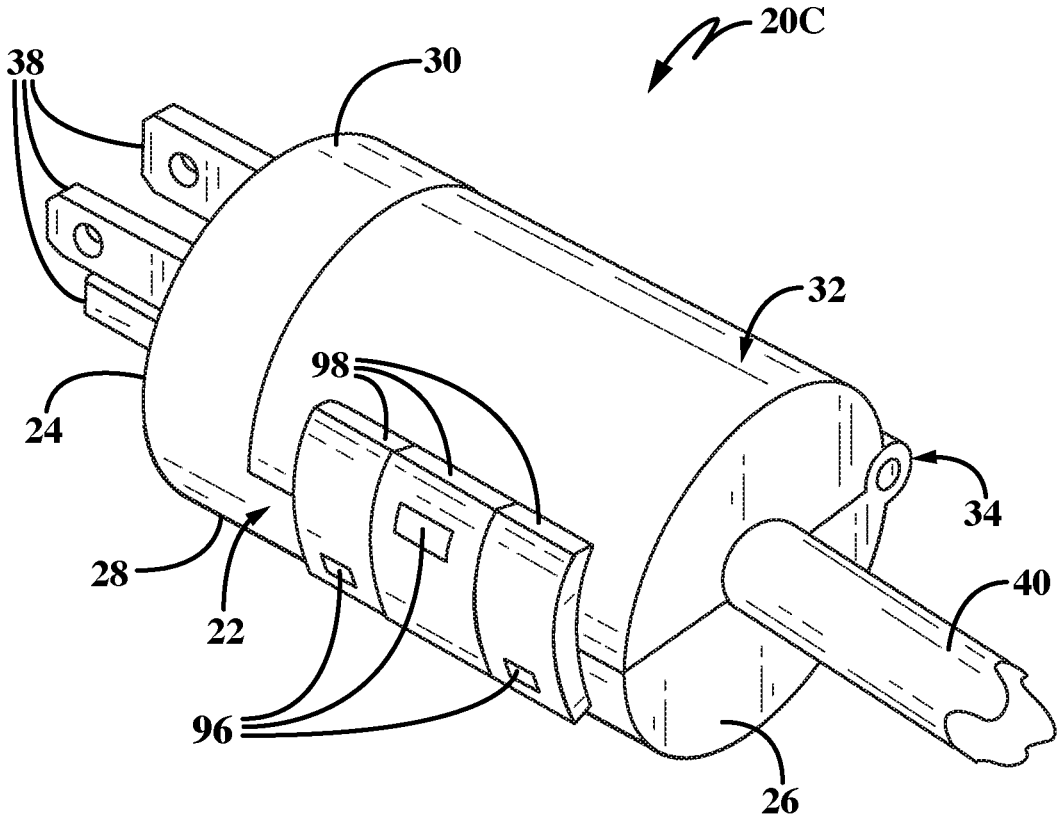
FIG. 9 is a perspective view of a fourth aspect electrical plug connector with the cover closed.
Figure 10:
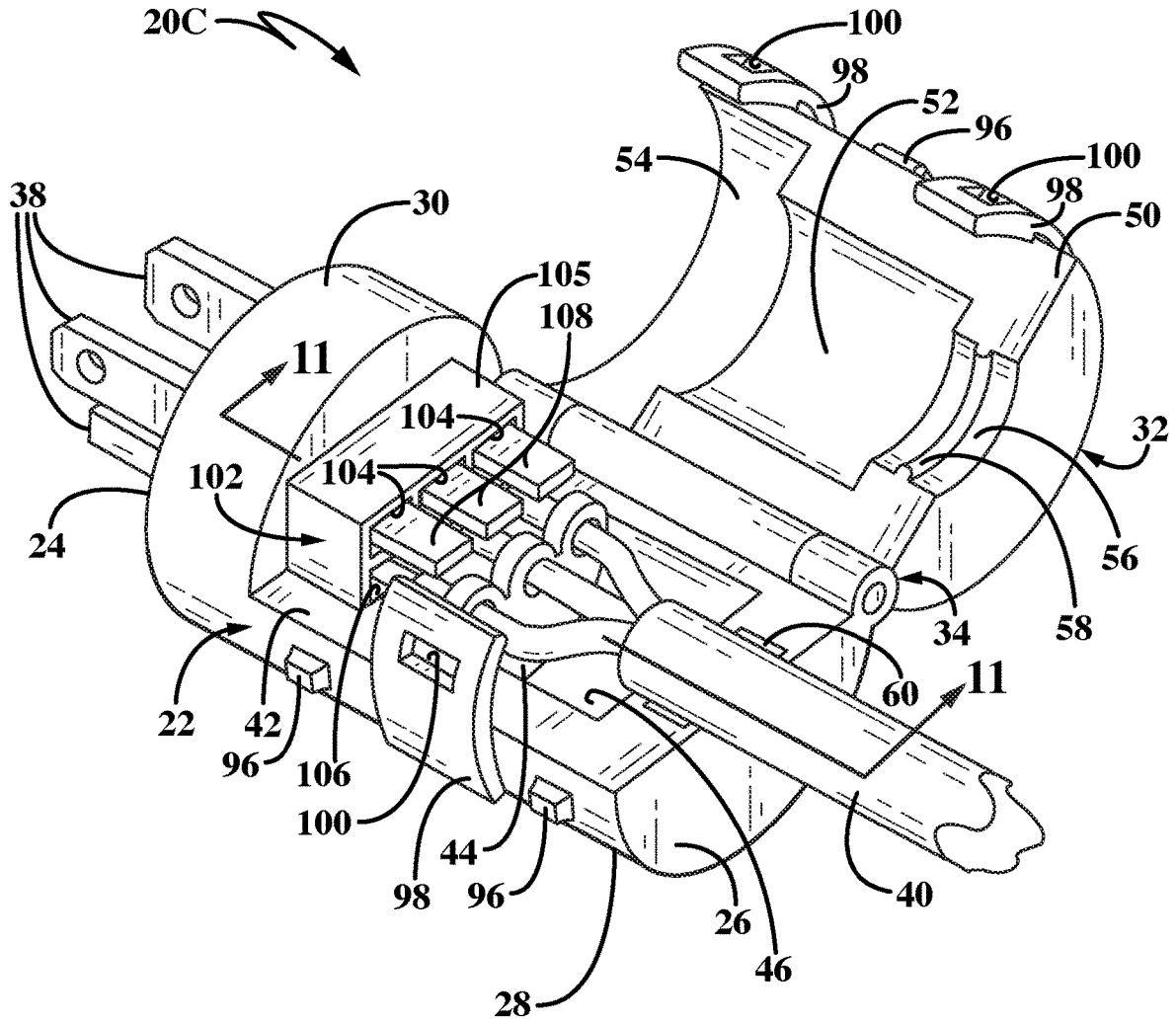
FIG. 10 is a perspective view of the fourth aspect electrical plug connector with the cover open.
Figure 11:
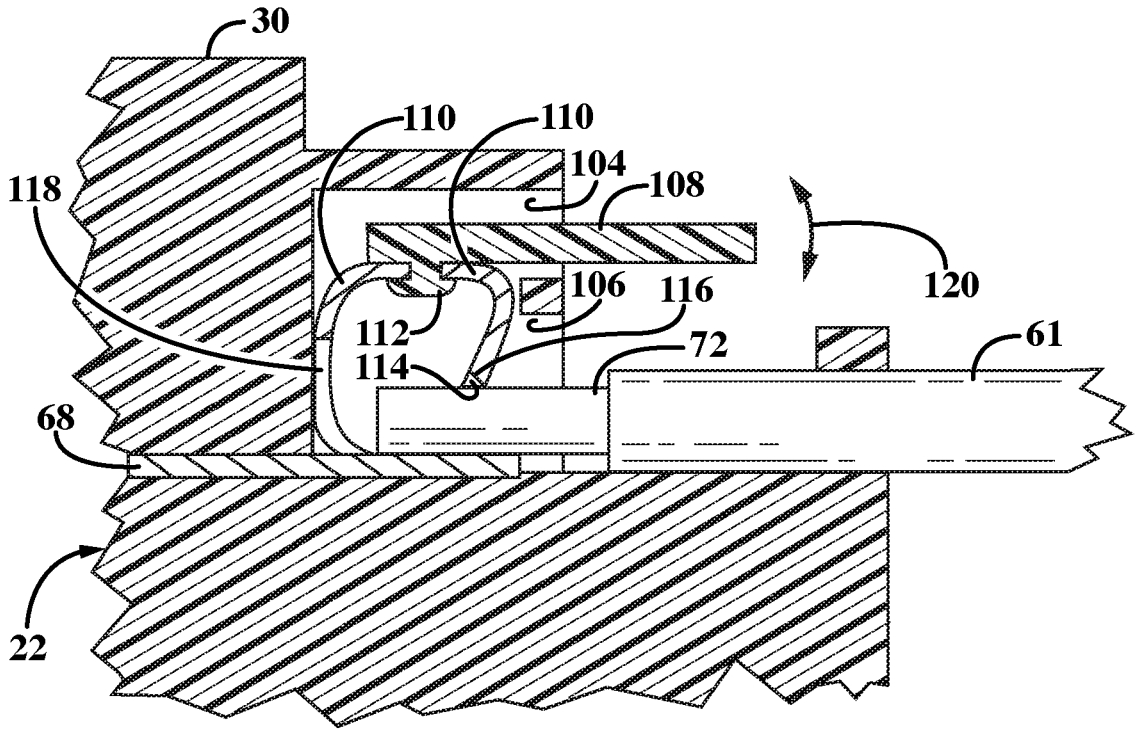
FIG. 11 is a sectional view taken generally about line 11-11 in FIG. 10.
Figure 12:
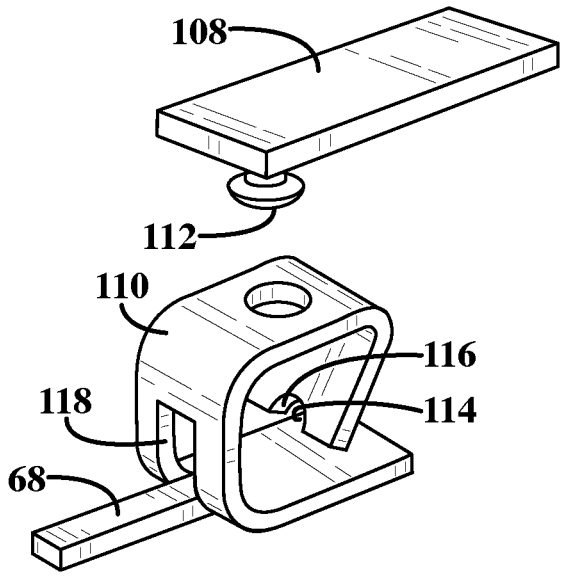
FIG. 12 is a perspective view of a spring biased clip.

FIGS. 6-8 illustrate a third aspect electrical plug connector having a body 22 similar to previously described aspects where wire separators 90 form a portion of wire receiving region 70 in conjunction with conductive member 68. In this aspect and others, conductive members 68 may be flat, rectangular, square, rounded, concave or convex without departing from the spirit and scope of the present disclosure. Cover 32 may include a base 92 with protrusions 94 extending therefrom. Wires 72 may also be positioned in guides to ensure proper orientation and alignment. Protrusions 94 may be aligned to be secured within each wire receiving region 70 and form a top portion of the wire receiving region. In this manner, protrusions 94 may contact wires 72 which are compressed into conductive members 68. Further, screws 36 can be engaged to further compress the wires 72 between the protrusions 94 and conductive members 68 and secure all three wires simultaneously.

FIGS. 9-12 illustrate various views of a fourth aspect electrical plug connector having a spring biased wire locking mechanism 102. The electrical plug connector may include one or more clasping mechanisms 98 each having an aperture 100 which is arranged to receive a locking tab 96. In one implementation, two clasping mechanisms 98 are positioned on cover 32 while a single clasping mechanism is positioned on the body 22. A person of skill in the art will immediately appreciate that any suitable number and orientation of clasping mechanisms may be utilized without departing from the spirit and scope of the disclosure.

Spring biased wire locking mechanism 102 may include a housing 105 having a plurality of upper openings 104 and a plurality of lower openings 106. Advantageously, upper openings 104 may be arranged to receive arms 108 while lower openings 106 may be arranged to receive wires 72. A spring 110 may be secured within housing 105 at mounting tab 112. A front portion of spring 110 may include a curved slot 114 at a terminating end 116. Advantageously, the operator may lift up on arm 108 in the direction associated with arrows 120 to provide clearance for wire 72 to fit within curved slot 114 at terminating end 116. Still further, a rear portion of spring 118 helps to ensure that the front portion is biased in the downward or locked position to resist wires 72 from being pulled outward.

While spring biased wire locking mechanism 102 is shown as utilizing an upward motion and a spring steel or other suitable spring mechanism, any number of other suitable spring biased orientations may be utilized. For example, a spring may be positioned on top of arm 108 and biases the internal portion of arm 108 within housing 105 downwards into wires 72. Accordingly, the operator may push the arm downwards in this implementation to provide clearance for inserting the wire 72 therein. Accordingly, the spring biased arm functions to securely hold the wires 72 within the electrical plug connector and resist the wires being pulled out when the arm is in the locked position.

The above description discloses a number of suitable exemplary aspects and implementations which can be implanted in an electrical plug connector to replace damaged, broken, or otherwise unwanted electrical cord plugs. Any of the disclosed aspects provide an effective and tamper resistant plug end which may also be waterproof with the addition of necessary seals.

It will be understood that implementations are not limited to the specific components disclosed herein, as virtually any components consistent with the intended operation of a method and/or system implementation for an electrical plug connector may be utilized. Components may comprise any shape, size, style, type, model, version, class, grade, measurement, concentration, material, weight, quantity, and/or the like consistent with the intended operation of a method and/or system implementation for an electrical plug connector.

The concepts disclosed herein are not limited to the specific implementations shown herein. For example, it is specifically contemplated that the components included in a particular implementation of an electrical plug connector may be formed of any of many different types of materials or combinations that can readily be formed into shaped objects and that are consistent with the intended operation of an electrical plug connector. For example, the components may be formed of: rubbers (synthetic and/or natural) and/or other like materials; polymers and/or other like materials; plastics, and/or other like materials; composites and/or other like materials; metals and/or other like materials; alloys and/or other like materials; and/or any combination of the foregoing.

Furthermore, embodiments of the electrical plug connector may be manufactured separately and then assembled together, or any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

In places where the description above refers to particular implementations of an electrical plug connector, it should be readily apparent that a number of modifications may be made without departing from the spirit thereof and that these implementations may be applied to other electrical plug connectors. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

We claim:

1. An electrical plug connector comprising:

a body having a cavity and at least one wire separator positioned between conductive members;

an electrical connection portion on the body;

a wire locking mechanism having a plurality of wire receiving regions each separated by the wire separator and having a spring biased receiving arm, the spring biased receiving arm mechanically coupled to and responsive to a lift arm;

wherein lifting pressure applied to the lift arm mechanically translates to a pivoting motion of the spring biased receiving arm to raise the spring biased receiving arm prior to insertion of a wire to allow insertion of a wire therein, wherein each of the spring biased receiving arms further comprises a terminating end with a curved slot in the terminating end; and electrically connecting the electrical connection portion and the wire.

2. The electrical plug connector of claim 1 wherein the spring biased receiving arm is pivoted upwards to allow insertion of the wire.

3. The electrical plug connector of claim 1 wherein each of the spring biased receiving arms are electrically connected to one of the conductive members.

4. An electrical plug connector comprising:

a body having a cavity comprising three electrically conductive members within the cavity, each of the three electrically conductive members being separately coupled in an electrically conductive manner to one of three electrical plug prongs extending from the body, each of the three electrically conductive members forming a separate one of three electrical wire receiving regions each configured to separately receive an exposed end of one of three electrical wires extending from an electrical cord, wherein each of the three electrically conductive members is electrically separated from each adjacent electrically conductive member of the three electrically conductive members by at least one electrically insulative separator;

a cord entry portion positioned at an edge of the body opposite the electrical plug prongs and configured to receive the electrical cord;

a wire guide positioned between the cord entry portion and the three electrically conductive members, the wire guide configured to receive the three electrical wires and guide the exposed ends of the three electrical wires toward their respective one of the three electrically conductive members;

a cover hingedly coupled to the base along a first edge; and a wire locking mechanism configured to lock and engage three electrical wires extending from an electrical cord in an electrically conductive manner, the wire locking mechanism formed between the cover and the body;

wherein the cover further comprising a plurality of protrusions each aligned with a different one of the three electrically conductive members and configured to extend between the insulative separators and contact a separate one of the three electrical wires when the cover is moved from its open position to its closed position.

5. The electrical plug connector of claim 4, wherein the three electrically conductive members each comprise spring biased receiving arm, the spring biased receiving arm mechanically coupled to and responsive to a lift arm, and wherein each of the spring biased receiving arms further comprises a terminating end with a curved slot in the terminating end.

6. The electrical plug connector of claim 4, further comprising at least one screw extending through the cover into the body adjacent the cord entry portion and configured to secure the cover to the body.

7. The electrical plug connector of claim 4, further comprising a gap between an upper edge of each of the insulative separators and the cover when the cover is in its closed position.

8. The electrical plug connector of claim 4, wherein the wire guide comprises three wire guide apertures extending therethrough, each of the three wire guide apertures aligned with a different one of the three electrical wire receiving regions.

9. An electrical plug connector comprising:

a body having a cavity comprising three electrical wire receiving areas within the cavity, each of the three electrical wire receiving areas being separately coupled in an electrically conductive manner to one of three electrical plug prongs extending from the body and configured to separately receive an exposed end of one of three electrical wires extending from an electrical cord, wherein each of the three electrical wire receiving areas is electrically separated from each other of the three electrical wire receiving area by at least one electrically insulative separator;

a wire guide comprising three guide openings, each guide opening positioned adjacent one of the three electrical wire receiving areas and configured to receive the three electrical wires and guide the exposed ends of the three electrical wires toward a different one of the three electrical wire receiving areas;

a cover hingedly coupled to the base along a first edge, the cover comprising a plurality of protrusions each aligned with a different one of the three electrical wire receiving areas and configured to extend between the insulative separators and contact a separate one of the three electrical wires when the cover is moved from its open position to its closed position; and a wire locking mechanism between the body and the cover and configured to lock and engage three electrical wires extending from an electrical cord in an electrically conductive manner with the three electrical wire receiving areas.

10. The electrical plug connector of claim 9, wherein the three electrical wire receiving areas each comprise spring biased receiving arm mechanically coupled and responsive to a lift arm, and wherein each of the spring biased receiving arms further comprises a terminating end with a curved slot in the terminating end.

11. The electrical plug connector of claim 9, further comprising at least one screw extending through the cover into the body adjacent the cord entry portion and configured to secure the cover to the body.

12. The electrical plug connector of claim 11, further comprising a gap between an upper edge of each of the insulative separators and the cover when the cover is in its closed position.

* * * * *